US005908010A

United States Patent [19]

Moroi et al.

[11] Patent Number: 5,908,010

[45] Date of Patent: Jun. 1, 1999

[54] VISCOUS FLUID HEATER

[75] Inventors: Takahiro Moroi; Takashi Ban; Shigeru Suzuki; Kazuhiko Minami, all of Kariya, Japan

[73] Assignee: Kabushiki Kaisha Toyoda Jidoshokki Seisakusho, Kariya, Japan

[21] Appl. No.: 09/030,471

[22] Filed: Feb. 25, 1998

[30] Foreign Application Priority Data

Feb. 26, 1997 [JP] Japan ..... 9-041901
Feb. 9, 1998 [JP] Japan ..... 10-027337

[51] Int. Cl.[6] ..... F22B 3/06

[52] U.S. Cl. ..... 122/26; 126/247

[58] Field of Search ..... 122/26; 126/247; 123/142.5 R

[56] References Cited

U.S. PATENT DOCUMENTS 4,974,778 12/1990 Bertling ..... 122/26
5,752,499 5/1998 Mori et al. ..... 122/26
5,829,676 11/1998 Ban et al. ..... 126/247

*Primary Examiner*—Teresa Walberg
*Assistant Examiner*—Gregory A. Wilson
*Attorney, Agent, or Firm*—Morgan & Finnegan, L.L.P.

[57] ABSTRACT

A heater containing viscous fluid, which is sheared to generate heat. The heater is provided with an electromagnetic solenoid that includes a case, a solenoid coil housed in the case, and a core extending through the case. The heater further has a heating chamber and a sub-oil chamber. Viscous fluid is moved between the heating chamber and the sub-oil chamber through a communication bore. The core extends toward the communication bore. A coil spring urges the core toward the communication bore. Excitation of the electromagnetic solenoid moves the core away from the communication bore. The core opens and closes the communication bore and pumps the viscous fluid into the communication bore when the solenoid is cycled on and off. As a result, the heat output is accelerated.

20 Claims, 2 Drawing Sheets

VISCOUS FLUID HEATER

BACKGROUND OF THE INVENTION

The present invention relates generally to a viscous fluid heater that generates heat by rotating a rotor in a heating chamber containing viscous fluid. More particularly, the present invention pertains to a viscous fluid heater capable of controlling heating performance.

An automotive vehicle is generally provided with a hot-water type heater. In a vehicle having such a heater, coolant is used to cool the engine. The coolant is heated by engine heat. The heater typically has a heater core housed in a duct. The heated coolant is sent to the heater core. This heats the air sent to the passenger compartment and warms the passenger compartment.

In a diesel engine vehicle or a lean burn engine vehicle, the amount of heat produced by the engine is relatively small. Thus, the amount of heat transmitted to the coolant is small. It is difficult for the coolant to reach a certain temperature such as 80° C. when the amount of heat sent to the heater core is small. Therefore, the heat used to warm the passenger compartment may be insufficient.

To solve this problem, a viscous fluid heater arranged in an engine coolant circulating circuit has been proposed. The viscous fluid heater is used for heating the coolant and includes a housing, which houses a heating chamber and a water jacket (heat exchange chamber). The heater also has a drive shaft and a rotor that are driven by the engine. Viscous fluid (such as high viscosity silicone oil) is contained in the heating chamber and is sheared by the rotor. This causes fluid friction and generates heat. The heat raises the temperature of the fluid (engine coolant) circulating through the water jacket.

The temperature of the viscous fluid contained in the heating chamber increases as the engine speed increases, regardless of the temperature of the circulating fluid flowing through the circulating circuit. When the high viscosity silicone oil is heated to a temperature of, for example, 250° C. or higher, the silicone oil becomes vulnerable to thermal deterioration caused by the heat and mechanical deterioration caused by the shearing. Such deterioration decreases the heating efficiency during the shearing. As a result, the heating performance of the heater, which is used to warm the passenger compartment, is degraded.

To prevent deterioration of the silicone oil, a heater that varies its heating performance has been proposed. U.S. Pat. No. 4,974,778 describes such a heater. When the passenger compartment is sufficiently warm, the heating performance is lowered to stop unnecessary shearing of the silicone oil with the rotor.

The heating performance is varied by moving the silicone oil between a heating chamber and a reservoir chamber to adjust the amount of silicone oil in the heating chamber. However, the high viscosity of the silicone oil slows the movement of the silicone oil from the reservoir chamber to the heating chamber, especially when adjusting the heating performance under lower temperatures. Such slow movement of the silicone oil interferes with the smooth charging of the silicone oil into the heating chamber. This degrades the responsiveness of the heater when varying the heating performance.

SUMMARY OF THE INVENTION

Accordingly, it is an objective of the present invention to provide a variable performance viscous fluid heater having a longer life and being capable of shearing a larger amount of viscous fluid. Another objective of the present invention is to provide a variable performance viscous fluid heater that maintains the required responsiveness.

To achieve the above objective, the present invention provides a viscous fluid type heater including a heat exchange chamber for conducting circulating coolant and a heating chamber containing viscous fluid and a rotor. The rotor rotates to shear the viscous fluid and produce heat. Heat is transferred from the heating chamber to the heat exchange chamber to heat the coolant. The heater further includes a subchamber connected to the heating chamber. The subchamber additionally contains viscous fluid. A pumping device positively delivers viscous fluid from the subchamber to the heating chamber. A controller controls the pumping device.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a viscous fluid heater according to the present invention will now be described with reference to FIGS. 1 and 2.

Figure 1:
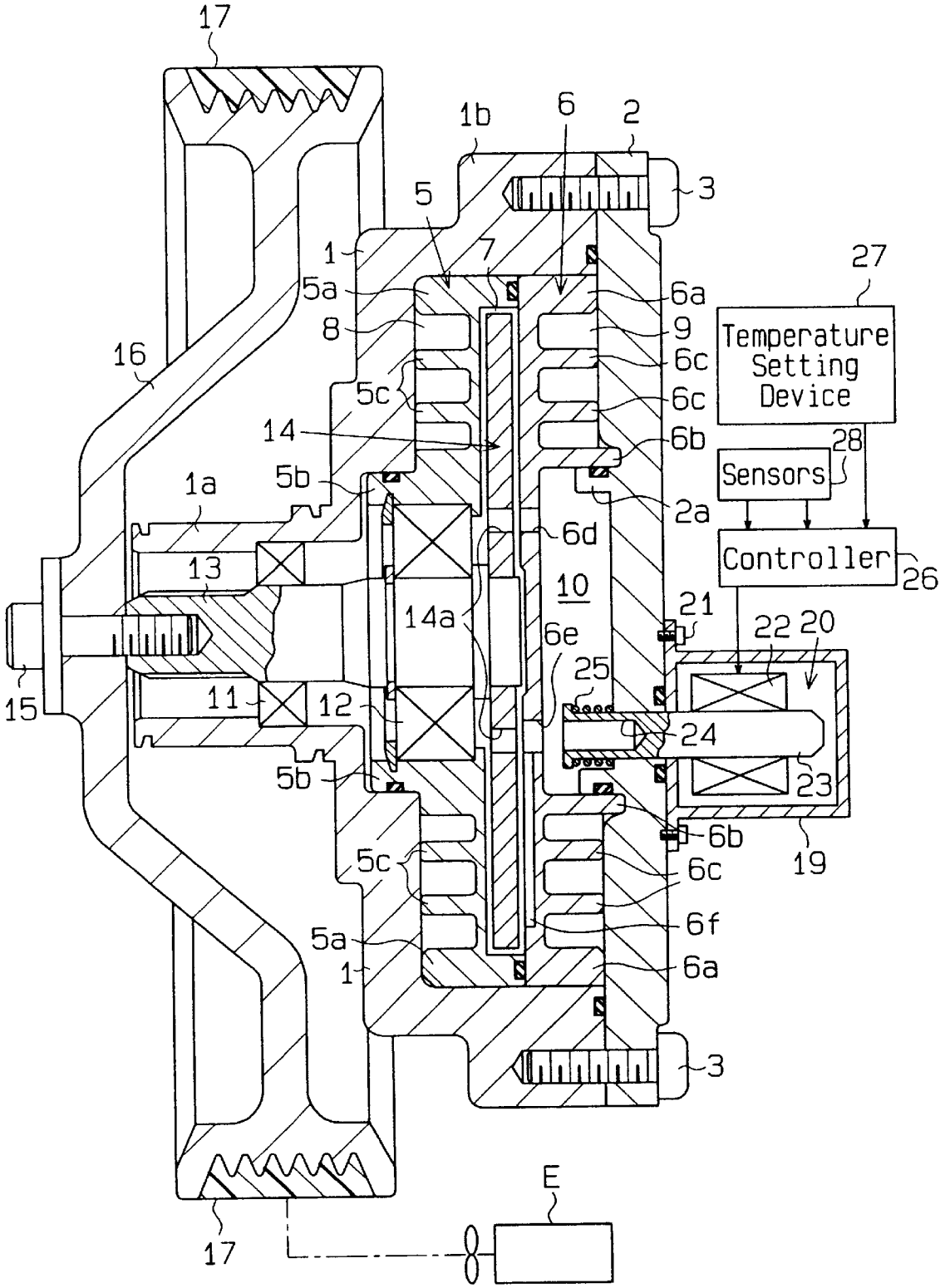
FIG. 1 is a longitudinal sectional view showing a variable performance viscous fluid heater with its valve body at an open position.

As shown in FIG. 1, the viscous fluid heater has a housing constituted by a front body 1 and a rear body 2. The front body 1 includes a cylindrical, hollow boss 1*a* and a bowl-like case 1*b*. The boss 1*a* extends toward the front of the heater (toward the left as viewed in the drawing) while the case 1*b* extends toward the rear from the boss 1*a*. The rear body 2 closes the opening of the case 1*b*. The front and rear bodies 1, 2 are fastened to each other by a plurality of bolts 3. A front plate 5 and a rear plate 6 are arranged in the case 1*b*.

An annular rim 5*a* extends along the periphery of the front plate 5, while an annular rim 6*a* extends along the periphery of the rear plate 6. The rims 5*a*, 6*a* are clamped to one another between the front and rear bodies 1, 2. Thus, the front and rear plates 5, 6 are held in a fixed manner. The rear side of the front plate 5 is hollow to define a heating chamber 7 when the front and rear plates 5, 6 are coupled to each other.

As described above, the housing of the heater is constituted by the front body 1, the rear body 2, the front plate 5, and the rear plate 6. Each of these housing constituents is made of aluminum or aluminum alloy.

A support hub 5*b* projects from the central portion of the front side of the front plate 5. A plurality of guide fins 5*c* extend concentrically on the front surface of the front plate 5. The front plate 5 is fitted in the front body 1 so that part of the support hub 5*b* is in contact with the inner wall of the front body 1. This defines an annular front water jacket 8 between the inner wall of the front body 1 and the front plate 5. The front water jacket 8, which serves as a heat exchange chamber, is adjacent to the front side of the heating chamber 7. Coolant circulates through the front water jacket 8. The flow of the coolant is guided by the rim 5*a*, the support hub 5*b*, and the guide fins 5*c*.

A hub 6*b* projects from the central portion of the rear side of the rear plate 6. A plurality of guide fins 6*c* extend concentrically on the rear surface of the rear plate 6. The rear plate 6 is fitted in the front body 1 together with the front plate 5 so that the support hub 6*b* is in contact with an annular wall 2*a*, which projects from the rear body 2. This defines an annular rear water jacket 9, located between the rear body 2 and the rear plate 6, and a sub-oil chamber 10, located in the hub 6*b*. The rear water jacket 9, which serves as a heat exchange chamber, is adjacent to the rear side of the heating chamber 7. The sub-oil chamber 10 serves as a reservoir. Coolant circulates through the rear water jacket 9. The flow of the coolant is guided by the rim 6*a*, the hub 6*b*, and the guide fins 6*c*.

The front body 1 has a side wall provided with an inlet port (not shown) and an outlet port (not shown) for each water jacket 8, 9. Each water jacket 8, 9 is connected to a vehicle heater circuit (not shown). The coolant circulating through the heater circuit enters each water jacket 8, 9 through the associated inlet port and exits the water jacket 8, 9 through the associated outlet port.

As shown in FIG. 1, a drive shaft 13 extends through the front body 1 and the front plate 5 and is rotatably supported by a bearing 11 and a bearing 12, which has a seal. The bearing 12 is arranged between the inner surface of the support hub 5*b* and the outer surface of the drive shaft 13. Thus, the sealed bearing 12 seals the front side of the heating chamber 7. A disk-like rotor 14 is fitted to the rear end of the drive shaft 13 in the heating chamber 7 so that the rotor 14 rotates integrally with the drive shaft 13. A plurality of rotor bores 14*a* extend axially through the central portion of the rotor 14 near the drive shaft 13. The rotor bores 14*a* are arranged at equal distances from the axis of the drive shaft 13 and with equal angles between adjacent bores 14*a*.

The sub-oil chamber 10, which serves as a reservoir, is defined in the region surrounded by the support hub 6*b* of the rear plate 6 and the rear wall of the rear body 2. Upper and lower communication bores 6*d*, 6*e* extend axially through the rear plate 6. A guide groove 6*f* extends radially along the rear plate 6. The upper communication bore 6*d* serves as a recovery passage, while the lower communication bore 6*e* serves as a supply passage. The heating chamber 7 and the sub-oil chamber 10 communicate with each other through the upper and lower communication bores 6*d*, 6*e*. The cross sectional area of the lower communication bore 6*e* is larger than that of the upper communication bore 6*d*. The upper communication bore 6*d* is located at the same radius as the rotor communication bores 14*a*. The upper communication bore 6*d* may be referred to as a recovery passage, and the lower communication bore may be referred to as a delivery passage.

The heating chamber 7 and the sub-oil chamber 10 define a sealed space that prevents the leakage of liquid. A certain amount of silicone oil, which serves as a viscous fluid, is charged into the sealed space. The silicone oil is charged until it occupies 50 percent to 80 percent of the sealed space volume under normal non-operating temperatures. When the rotor 14 is rotated, silicone oil is supplied to the heating chamber 7 from the sub-oil chamber 10 through the lower communication bore 6*e* and the guide groove 6*f*. At the same time, heated silicone oil is recovered from the heating chamber 7 and sent to the sub-oil chamber 10 through the upper communication bore 6*d*. Therefore, the silicone oil is circulated between the heating chamber 7 and the sub-oil chamber 10.

Figure 2:
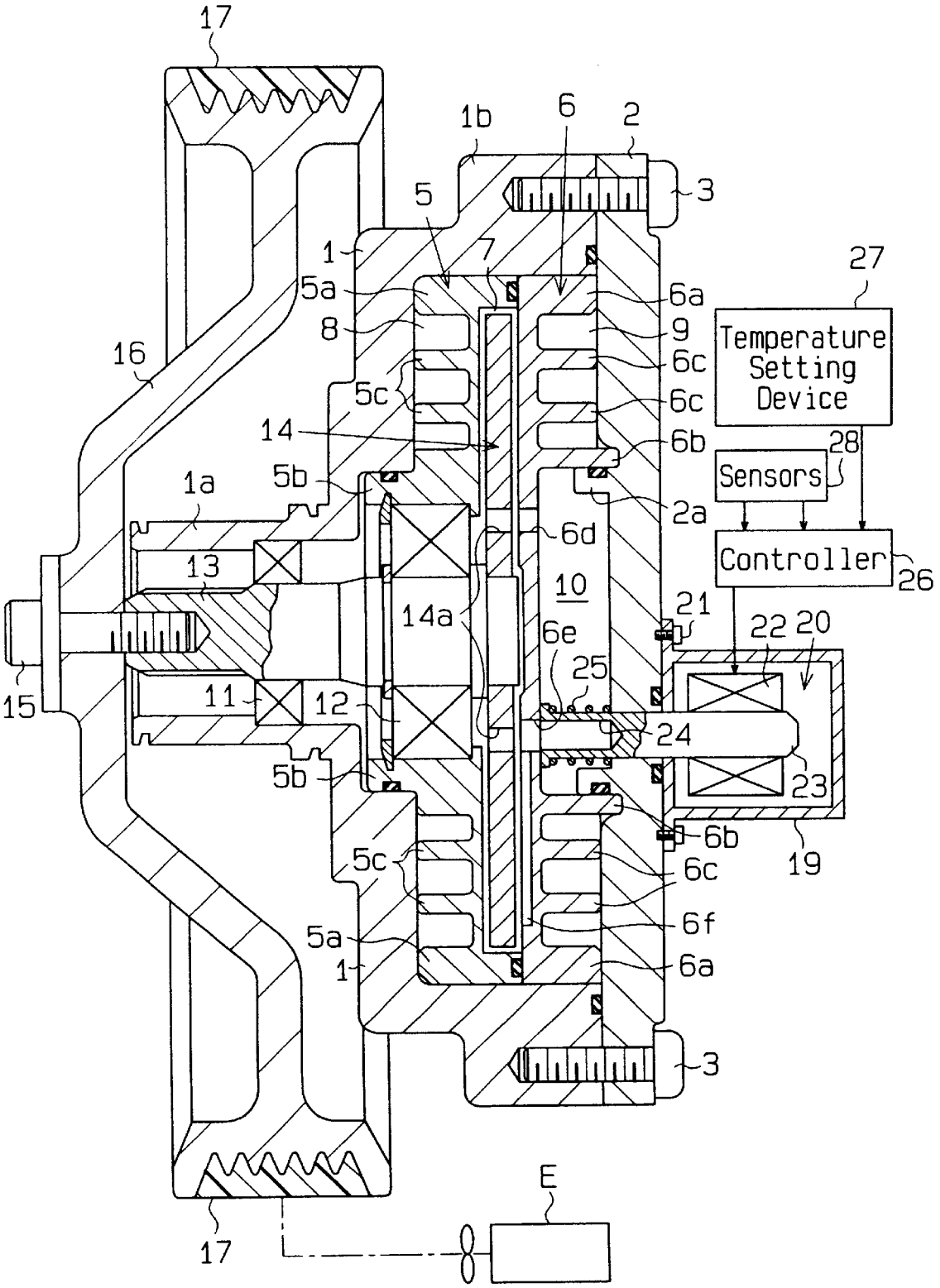
FIG. 2 is a longitudinal sectional view showing the variable performance viscous fluid heater when the valve body is closed.

As shown in FIGS. 1 and 2, a valve operated by an electromagnetic solenoid 20 is provided in the rear body 2. The electromagnetic solenoid 20 is housed in a valve case 19 and fixed to the outer side of the rear body 2 by a plurality of bolts 21. The electromagnetic solenoid 20 includes a solenoid coil 22 and a core 23. The solenoid coil 22 is arranged in the valve case 19. The core 23 serves as a movable body, or valve body, and extends through the center of the solenoid coil 22 so that the core 23 slides axially through the rear body 2. The distal end of the core 23 is aligned with the lower communication bore 6*e*, which serves as the supply passage, in the sub-oil chamber 10. A hole 24 is formed in the distal end of the core 23. The diameter of the distal end of the core 23 is larger than the diameter of the lower communication bore 6*e* to enable the distal end of the core 23 to close the lower communication bore 6*e*. A coil spring 25, serving as an urging member, is arranged between the distal end of the core 23 and the inner wall of the sub-oil chamber 10 to urge the core 23 toward the rear plate 6. The electromagnetic solenoid 20, which includes the solenoid coil 22, the core 23, and the coil spring 25, forms a valve device. The solenoid coil 22 and the coil spring 25 form a valve body actuator.

The viscous fluid heater of this embodiment incorporates a controller 26 that controls the circulation of the viscous fluid between the heating chamber 7 and the sub-oil chamber 10. The controller 26 may be located at a separate location from the viscous fluid heater. In this case, the functions of the controller 26 may be performed by a vehicle electronic control unit (ECU), which performs other tasks as well.

The controller 26 is a microcomputer having a central processing unit (CPU), a read only memory (ROM), a random access memory (RAM) and an input/output interface (all not shown). A control program is stored in the ROM. This controller 26 may be connected to sensors 28, such as a temperature sensor for detecting the temperature inside or outside the vehicle, a temperature sensor for detecting the temperature of fluid (engine coolant) circulating through the heater circuit, a temperature sensor for detecting the temperature of the silicone oil in the heating chamber 7 or the sub-oil chamber 10, or a sensor for detecting the engine speed.

Each of these sensors outputs data of the detected temperature or engine speed as analog or digital signals. The controller 26 receives signals from each sensor 28 and is connected to a temperature-setting device 27 and a switching device (not shown) installed in the passenger compartment. Thus, the controller 26 receives various kinds of control information. The temperature-setting device 27 is used to set the preferred temperature in the passenger compartment. The controller 26 is connected with the solenoid coil 22 to control the excitation of the solenoid coil 22 based on a control program.

A pulley 16 is fixed to the front end of the drive shaft 13 by bolts 15. The pulley 16 is connected to an engine E, which serves as an exterior drive source, by a V-belt 17.

The operation of the viscous fluid heater will now be described. When the rotation of the drive shaft 13, the rotor 14, and the pulley 16 is stopped, the solenoid coil 22 is de-excited. Thus, the coil spring 25 urges the distal end of the core 23 to close the lower communication bore 6*c*, as shown in FIG. 2. In this state, surface levels of the silicone oil in the heating chamber 7 and the silicone oil in the sub-oil chamber 10 are below the upper communication bore 6*d*. When the engine 17 starts to rotate the drive shaft 13 by means of the pulley 16, the rotor 14 is rotated integrally with the drive shaft 13. At the same time, the controller 26 excites the solenoid coil 22 if the switching device is turned on. When current flows through the solenoid coil 22, electromagnetic force moves the core 23 away from the rear plate 6. This opens the lower communication bore 6*e*. As a result, the heating chamber 7 and the sub-oil chamber 10 communicate with each other. This permits the oil in the sub-oil chamber 10 to flow into the heating chamber 7. Thus, the movement of the core 23 also causes the silicone oil in the sub-oil chamber 10 to enter the hole 24 in the distal end of the core 23.

The controller 26 repetitively excites and de-excites the solenoid coil 22 for a certain number of times (e.g., 2 to 10 times) until a certain amount of time (predetermined control time) elapses from when the rotation of the rotor 14 is commenced. In other words, the flow of current through the solenoid coil 22 is stopped immediately after it is started. When the coil 22 is de-excited, the coil spring 25 urges the core 23 toward the rear plate 6 by the coil spring 25 until the distal end of the core 23 contacts the rear plate 6 (the closed position of the core 23). The abutment of the core 23 against the rear plate 6 suddenly stops the core. In this position, the hole 24 in the distal end of the core 23 communicates with the lower communication bore 6*e*. Thus, inertial force acts on the silicone oil contained in the hole 24 and forces the oil into the heating chamber 7 through the lower communication bore 6*e*. The controller 26 then commences the flow of current to the solenoid coil 22 and moves the core 23 away from the rear plate 6 against the force of the coil spring 25 (the open position of the core 23). The controller 26 repeats the exciting and de-exciting of the solenoid coil 22 until the predetermined control time elapses.

In this manner, the core 23 is reciprocated in the sub-oil chamber 10 for a certain period of time from the moment the rotor 14 starts to rotate. The continuous reciprocation of the core 23 pumps silicone oil into the lower communication bore 6*e*. After the pumping action is terminated, current continuously flows from the controller 26 to the solenoid coil 22, until the required heating performance of the heater is obtained. This holds the core 23 at the rearward position (open position) and keeps the lower communication bore 6*e* open, as shown in FIG. 1.

When the rotor 14 is rotated, the high viscosity of the silicone oil causes the silicone oil in the sub-oil chamber 10 to be drawn into the heating chamber 7 through the open lower communication bore 6*e*. The pumping action further forces the silicone oil in the sub-oil chamber 10 into the heating chamber 7. Accordingly, even if the rotation of the rotor 14 is commenced from a stationary state, the oil spreads quickly and smoothly to the entire heating chamber 7 including the narrow clearances between the inner walls of the heating chamber 7 and the outer surface of the rotor 14. In this manner, silicone oil is delivered to the top of the rotor 14 within a short period of time. Silicone oil is also recovered quickly through the upper communication bore 6*d*. Therefore, silicone oil is circulated between the heating chamber 7 and the sub-oil chamber 10 within a short period of time.

The silicone oil, which fills the clearance between the inner walls of the heating chamber 7 and the outer surface of the rotor 14, is sheared to generate heat. The heat generated in the heating chamber 7 is exchanged with the circulating fluid flowing through each water jacket 8, 9. The heated circulating fluid is sent to the heater circuit (not shown) for warming the passenger compartment.

During normal rotation of the drive shaft 13, the rotor 14, and the pulley 16, the controller 26 performs feedback control to adjust the heating performance of the heater. The controller 26 refers to the data sent from the sensors 28 to control the electromagnetic solenoid 20 and maintains the temperature in the passenger compartment at the temperature set by a temperature-setting device 27.

If the temperature in the passenger compartment greatly exceeds the set value, the controller 26 stops the current flowing through the solenoid coil 22. As a result, the core 23 closes the lower communication bore 6*e*. This stops the flow of oil from the sub-oil chamber 10 to the heating chamber 7, while the recovery of oil through the upper communication bore 6*d* continues. Since the oil in the heating chamber 7 decreases gradually, the rotor 14 is rotated without shearing oil. Accordingly, the shearing force decreases and the amount of heat generated by the heater is reduced.

On the other hand, if the temperature in the passenger compartment becomes lower than the set value to a great extent, the controller 26 commences the current flow to the solenoid coil 22. This moves the core 23 away from the rear plate 6 and opens the lower communication bore 6*e*. If the lower communication bore 6*e* has been closed for a long period of time, silicone oil may be positively sent to the heating chamber 7 from the sub-oil chamber 10 by repeating the excitation and de-excitation of the solenoid coil 22 for a certain period of time, such as when the rotation of the rotor 14 is started. The flow of oil from the sub-oil chamber 10 to the heating chamber 7 is restarted in this manner. Because of the difference between the inner diameter of the lower communication bore 6*e* and the inner diameter of the upper communication bores 6*d*, The amount of oil supplied to the heating chamber 10 is greater than the amount of oil recovered from the heating chamber 10. Since the amount of silicone oil in the heating chamber 7 increases gradually, silicone oil fills the space between the rotor 14 and the inner wall of the heating chamber 7 entirely. Therefore, the shearing force is increased again. The amount of generated heat increases as well.

In this manner, the viscous fluid heater variably controls the heating performance by opening or closing the lower communication bore 6*e*, which serves as a supply passage, with the core 23. The upper and lower communication bores 6*d*, 6*e*, which communicate the heating chamber 7 and the sub-oil chamber 10, the electromagnetic solenoid 20 including the core 23, and the controller 26 constitute a variable heating performance mechanism.

The preferred and illustrated embodiment has the following advantages.

When the flow of silicone oil from the sub-oil chamber 10 to the heating chamber 7 is started, such as when the rotation of the rotor 14 is initiated, the core 23 carries out a pumping action. The action is repeated several times by exciting and de-exciting the electromagnetic solenoid 20. This pumps the silicone oil in the sub-oil chamber 10 to the heating chamber 7 through the lower communication bore 6*e* even if the supply of oil from the heating chamber 7 to the sub-oil chamber has not reached a normal state. Therefore, the necessary amount of silicone oil is positively supplied to the heating chamber 7. Thus, the heating performance is rapidly increased when starting the operation of the heater.

The heating performance is controlled as required, by adjusting the amount of oil in the heating chamber 7 when the rotor 14 rotates. The amount of oil is adjusted by controlling the opening and closing of the lower communication bore 6*e* with the core 23. This prevents overheating of the silicone oil caused by unnecessary heating in the heating chamber 7. Therefore, thermal deterioration by overheating and mechanical deterioration by shearing of silicone oil are postponed.

The opening and closing of the lower communication bore 6*e* with the core 23 and the pumping action of the core 23 are achieved by exciting and de-exciting the electromagnetic solenoid 20 with the controller 26. A simple structure variably controls the heat performance by adjusting the amount of silicone oil in the heating chamber 7. Furthermore, the heater rapidly reaches the required heat output level.

The hole 24 is formed in the distal end of the core 23 of the valve body. This permits the silicone oil in the sub-oil chamber 10 to enter the hole 24 when the core 23 is moved. The hole 24 also decreases the weight of the core 23. This allows the core 23 to move at a faster speed. When the core 23 moves toward the rear plate 6 and contacts the rear plate 6, the oil contained in the hole 24 is forcibly sent to the heating chamber 7 by inertia. Accordingly, the pumping action increases the force urging the silicone oil through the bore 6*e*.

Optionally, the preferred embodiment may be modified or operated as described below.

When the rotor 14 is rotating normally, the pumping action of the core 23 may be conducted for a predetermined period (such as 2 to 5 seconds) from the moment the lower communication bore 6*e* is opened to vary the heating performance of the heater.

This operation pumps cooled silicone oil reserved in the sub-oil chamber 10 to the heating chamber 7. Therefore, the heating chamber 7 is efficiently filled with silicone oil. This achieves the required heating performance within a short period of time.

The controller 26 does not necessarily have to shift the core 23 to the closed position to carry out the pumping action. More specifically, the distal end of the core 23 need not contact the rear plate 6 as long as the reciprocal action of the core 23 sufficiently forces the silicone oil in the sub-oil chamber 10 into the heating chamber 7.

The controller 26 may decide whether or not to perform the pumping action with the core 23 by analyzing the data sent from the sensors 28. For example, the controller 26 may refer to the temperature of the silicone oil sent from a temperature sensor. If the silicone oil temperature is higher than a predetermined temperature, this indicates that the viscosity of the oil has decreased by a certain level. In this case, the silicone oil smoothly moves into the heating chamber 7 through the lower communication bore 6*e* without being pumped. This methods results in the same advantages described previously. The controller 26 may also decide not to execute the repetitive excitation control of the solenoid coil 22 in accordance with the data sent from the sensors 28.

The term "viscous fluid" refers to any type of medium that generates heat based on fluid friction when sheared by a rotor. The term is therefore not limited to viscous fluid or semi-fluid having high viscosity, much less to silicone oil.

It should be apparent to those skilled in the art that the present invention may be embodied in may other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A viscous fluid type heater comprising:

a heat exchange chamber for conducting circulating coolant;

a heating chamber containing viscous fluid and a rotor, wherein the rotor rotates to shear the viscous fluid and produce heat, wherein heat is transferred from the heating chamber to the heat exchange chamber to heat the coolant;

a subchamber connected to the heating chamber, the subchamber additionally containing viscous fluid;

a pumping device for positively delivering viscous fluid from the subchamber to the heating chamber; and a controller for controlling the pumping device.

2. The heater as set forth in claim 1, further comprising a delivery passage for connecting the subchamber with the heating chamber, wherein the pumping device includes a movable body in the subchamber, wherein the body is moved towards and away from the delivery passage.

3. The heater as set forth in claim 2, wherein the pumping device includes an electromagnetic solenoid, which is selectively energized and deenergized to drive the body towards and away from the delivery passage.

4. The heater as set forth in claim 3, wherein the controller instructs the solenoid to reciprocate the body for a predetermined time period.

5. The heater as set forth in claim 2, further comprising a recovery passage that allows the viscous fluid to move into the subchamber from the heating chamber.

6. The heater as set forth in claim 5, wherein the recovery passage is smaller than the delivery passage.

7. The heater as set forth in claim 2, wherein the body has a rod-like shape and has an end surface that opposes the delivery passage, wherein the end surface has an axial recess aligned with the delivery passage.

8. The heater as set firth in claim 1, wherein the viscous fluid is silicone oil.

9. A viscous fluid type heater comprising:

a heat exchange chamber for conducting circulating coolant;

a heating chamber containing viscous fluid and a rotor, wherein the rotor rotates to shear the viscous fluid and produce heat, wherein heat is transferred from the heating chamber to the heat exchange chamber to heat the coolant;

a subchamber connected to the heating chamber, the subchamber additionally containing viscous fluid;

a delivery passage connecting the subchamber with the heating chamber; and a reciprocal body located proximal to the delivery passage for urging viscous fluid from the subchamber to the heating chamber through the delivery passage.

10. The heater as set forth in claim 9, wherein the body is reciprocated by an electromagnetic solenoid, which is selectively energized and deenergized to drive the body towards and away from the delivery passage.

11. The heater as set forth in claim 10 further comprising a controller, wherein the controller instructs the solenoid to reciprocate the body for a predetermined time period.

12. The heater as set forth in claim 9, further comprising a recovery passage that allows the viscous fluid to move into the subchamber from the heating chamber.

13. The heater as set forth in claim 12, wherein the recovery passage is smaller than the delivery passage.

14. The heater as set forth in claim 9, wherein the body has a rod-like shape and has an end surface that opposes the delivery passage, wherein the end surface has an axial recess aligned with the delivery passage.

15. The heater as set forth in claim 10, wherein the body has a rod-like shape and has an end surface that opposes the delivery passage, wherein the end surface has an axial recess aligned with the delivery passage, and wherein the end surface is annularly shaped such that the end surface surrounds and closes the delivery passage when the body moves toward the delivery passage.

16. The heater as set forth in claim 9 further comprising:

a drive shaft that supports the rotor and rotates integrally with the rotor;

a pulley attached to the drive shaft; and a belt engaged with the pulley to drive the pulley.

17. The heater as set forth in claim 9, wherein the body has a rod-like shape and has an end surface that opposes the delivery passage, wherein the end surface has an axial recess aligned with the delivery passage.

18. A viscous fluid type heater comprising:

a heat exchange chamber for conducting circulating coolant;

a heating chamber containing viscous fluid and a rotor, wherein the rotor rotates to shear the viscous fluid and produce heat, wherein heat is transferred from the heating chamber to the heat exchange chamber to heat the coolant;

a subchamber connected to the heating chamber, the subchamber additionally containing viscous fluid;

a delivery passage connecting the subchamber with the heating chamber to permit viscous fluid to enter the heating chamber from the subchamber;

a recovery passage connecting the heating chamber with the subchamber to permit viscous fluid to enter the subchamber from the heating chamber; and a pumping device for urging viscous fluid from the subchamber to the heating chamber through the delivery passage, wherein the pumping device includes a movable body located in the subchamber.

19. The heater as set forth in claim 18, wherein the body is reciprocated by an electromagnetic solenoid, which is selectively energized and deenergized to drive the body towards and away from the delivery passage.

20. The heater as set forth in claim 19 further comprising a controller, wherein the controller instructs the solenoid to reciprocate the body for a predetermined time period.

* * * * *